United States Patent [19]

John et al.

[11] Patent Number: 4,558,825

[45] Date of Patent: Dec. 17, 1985

[54] AGITATOR MILL

[75] Inventors: Willy John; Norbert Klimaschka, both of Selb; Arno Wagner, Bochum; Günther Meyer, Selb, all of Fed. Rep. of Germany

[73] Assignee: Gebruder Netzsch Maschinenfabrik GmbH & Co., Selb, Fed. Rep. of Germany

[21] Appl. No.: 497,366

[22] Filed: May 23, 1983

[30] Foreign Application Priority Data

May 25, 1982 [DE] Fed. Rep. of Germany ..... 3219549
Sep. 10, 1982 [DE] Fed. Rep. of Germany ..... 3233626

[51] Int. Cl.[4] ..... B02C 17/18
[52] U.S. Cl. ..... 241/171; 241/DIG. 30
[58] Field of Search ..... 241/DIG. 30, 170, 171, 241/5, 30, 172–184

[56] References Cited

U.S. PATENT DOCUMENTS 801,854 10/1905 Dorey ..... 241/171 X
1,086,024 2/1914 Capen ..... 241/171
1,712,082 5/1929 Koppers ..... 241/170 X
2,592,783 4/1952 Aspegren ..... 241/171 X
2,595,117 4/1952 Ahlmann ..... 241/172 X

FOREIGN PATENT DOCUMENTS 2242174 8/1972 Fed. Rep. of Germany .

*Primary Examiner*—Mark Rosenbaum
*Attorney, Agent, or Firm*—Karl W. Flocks; Sheridan Neimark; A. Fred Starobin

[57] ABSTRACT

An agitator mill comprising a grinding vessel (3) which encloses a grinding area, a storage vessel (37) which contains grinding bodies (28), and a device (8) for feeding grinding bodies (28) from the storage vessel (37) into the grinding area. This device (8) essentially consists of a housing (11) attached to the grinding vessel (3) and a rotatable worm (13) situated therein. When the worm (13) is rotated, the grinding bodies (28) may be fed trouble-free as required into the grinding area, even if re-used grinding bodies (28) are concerned which have been worn out of true and have varied diameters.

8 Claims, 7 Drawing Figures

AGITATOR MILL

FIELD OF THE INVENTION

The present invention relates to an agitator mill comprising a grinding vessel which encloses a grinding area, and a storage vessel which contains grinding bodies, and a device for feeding grinding bodies from the storage vessel into the grinding area, comprising a housing and a drivable conveying member disposed therein.

BACKGROUND OF THE INVENTION

During operation of an agitator mill, the grinding bodies in the grinding area are subject to wear so that their total quantity is gradually diminished. When fine grinding ferrites and similarly abrasive material, the wear on the grinding bodies can be so great that a certain amount of grinding bodies must be replenished in the grinding area on every day of production in order to keep about constant the part by volume of the grinding area which is filled with grinding bodies. In larger agitator mills, a daily loss of several kilograms of grinding bodies can occur.

In closed agitator mills, in particular continuously working ones, slight excess pressure prevails in the grinding area. For this reason, grinding bodies cannot easily be replenished during operation of such an agitator mill; it is therefore usual to compensate for the loss of grinding bodies only at greater intervals in time, for example, daily before starting up operation or after operations ends, by replenishing grinding bodies. However, working with a filling of grinding bodies which steadily lessens during the course of the day has as its result that material ground in the evening is less fine than material ground in the morning although the material to be ground has been in the grinding area for an identical length of time.

This disadvantage can be avoided if the agitator mill has a device which works continuously or at short intervals to feed grinding bodies from a storage vessel into the grinding area. Such a device comprising a housing disposed between storage vessel and grinding area and a drivable conveying member disposed therein is known from DE No. 2 242 174 A1. In this device, the housing has a cylindrical bore opening out into the grinding area, said bore having a slighty smaller diameter than the diameter of the grinding bodies. The wall of the bore is resilient so that the grinding bodies can be pressed through the bore one after the other and each time at least one grinding body tightly seals the bore. A piston is disposed in a portion of the bore averted from the grinding area to act as a conveying member and said piston is movable to and fro by a crank gear so that it exerts force by strokes on the hindmost grinding body and this force is transmitted over several grinding bodies lying one behind the other in the bore so that on each forward stroke the foremost grinding body is pushed into the grinding area. On each back stroke, the piston makes free the opening of a supply line through which a fresh grinding body from the storage vessel falls into the bore.

It has become apparent that this known device only works reliably if the grinding bodies are all of the same size and have a relatively exact spherical form. These conditions are only fulfilled by new and well-sorted grinding spheres; used grinding bodies cannot be fed anew by means of the known device into the grinding area.

SUMMARY OF THE INVENTION

It is, therefore, an object of the invention to equip an agitator mill with a device for feeding grinding bodies which also makes possible the re-use of partially worn grinding bodies.

According to the invention, in an agitator mill of the type described at the outset, the conveying member is a rotatable worm. It has surprisingly emerged that even grinding bodies with considerably different diameters and deviations from the spherical form do not tend to jam between the worm and the housing.

The worm can end at a distance from the grinding area in the proximity of the starting point of a canal whose cross section increases in the direction of the grinding area. This has the advantage on the one hand that the worm is protected from being worn by the grinding bodies moving in the grinding area and, on the other hand, that congestions of the canal are avoided.

Preferably, the inner area of the housing, which receives the worm, and the storage vessel are tightly sealed against the outer environment.

The worm can have a drive pin which is connected via a coupling sleeve with an output pin of a motor, said coupling sleeve having an outer envelope surface which is sealed against the housing by a stuffing box.

Suitably, the housing has a cylindrical inner wall. In this case, it is advantageous if the worm has a conical core with a diameter decreasing in conveying direction. Congestion is thus counteracted.

The storage vessel can be connected with an inlet-pipe connection of the housing. In this case, it has proved expedient that a spiral portion of the worm arranged in the area of the inlet-pipe connection be formed of resilient material. Wear of the worm and the housing in the area of the inlet is thus counteracted.

A corresponding result can be achieved when the worm in the area of the inlet-pipe connection has a smaller diameter than inside a main portion of the housing which joins up with the inlet-pipe connection.

A particularly effective protection against wear can be achieved either when the worm is entirely coated with a layer of resilient material or when the housing is lined with such a layer.

If the agitator mill has a vertical grinding vessel, it is advantageous if the worm is disposed in at least approximately horizontal position in an upper portion of the grinding vessel.

BRIEF DESCRIPTION OF THE DRAWINGS

Embodiments of the invention will now be described in greater detail with reference to the attached drawings in which.

DESCRIPTION OF THE EMBODIMENTS

Figure 1:
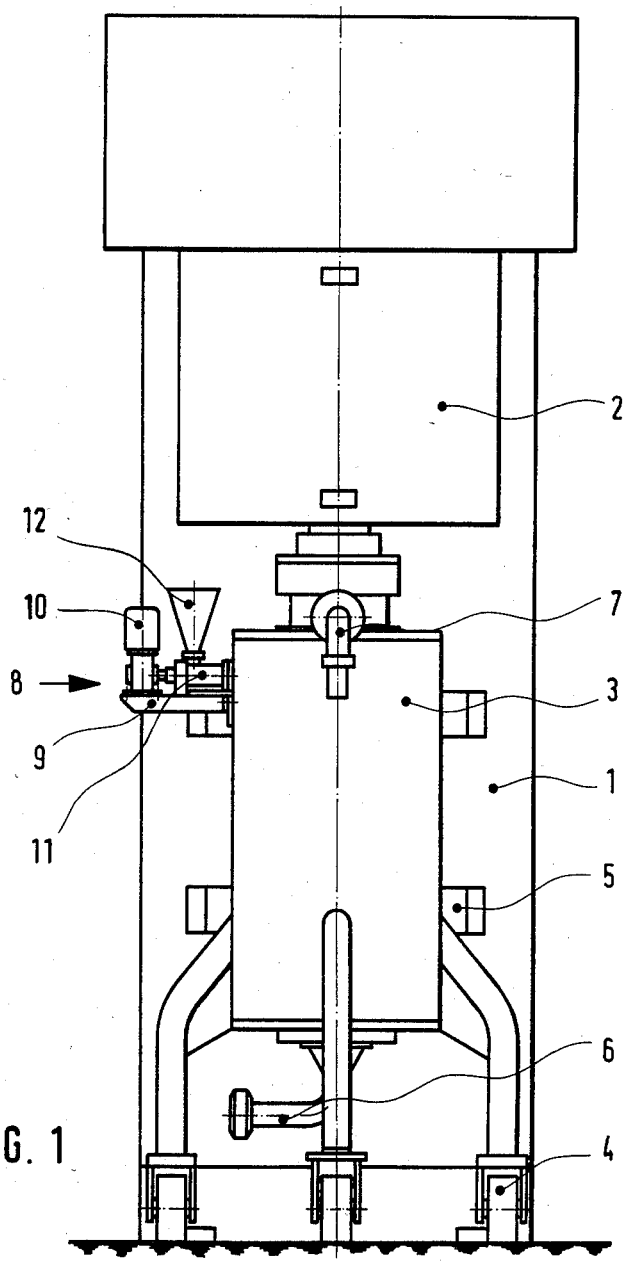
FIG. 1 is a side elevational view of a vertical agitator mill comprising a device for feeding in grinding bodies.

In FIG. 1, a frame 1 of an agitator mill is shown, containing a driving motor, gearing and a regulating apparatus. A cover 2 masks a clutch which connects the gearing with an agitator shaft (not visible in the drawings) which projects from above into a grinding vessel 3. The grinding vessel 3 stands on supports with rollers 4 and in operation is secured by holders 5 on the frame 1.

A pipe 6 is disposed on the floor of the grinding vessel 3 and the material to be ground is fed through said pipe by a pump (not shown) into a grinding area in the interior of the grinding vessel 3. At the upper end of the grinding vessel 3 is a pipe 7 through which the treated material leaves the grinding area.

In an upper portion of the grinding vessel 3, a device 8 is attached laterally for feeding grinding bodies into the grinding area. For this purpose, a bracket 9 is secured at the grinding vessel 3 and on said bracket, a geared motor 10 and a housing 11 with mounted hopper 12 are arranged. Details of the device 8 are to be seen in FIGS. 2 through 7.

In all embodiments illustrated in FIGS. 2 through 7, a worm 13 made of hardened steel is disposed horizontally in the housing 11. According to FIGS. 2, 5 and 6, the housing has a flange 14 fastened to a socket-like insert 15. The insert 15 extends through a cooling jacket 16 of the grinding vessel 3 and is welded together with a double wall 17. The grinding area connects with the right end of the insert 15. In the embodiments illustrated in FIGS. 2 and 5, the worm 13 extends within the insert 15 through the wall 17 of the grinding vessel 3 and only ends directly before the grinding area.

At the other end, the worm 13 has a drive pin 18 which is connected via a coupling sleeve 20 and a key 21 to an output pin 19 of the geared motor 10 illustrated in FIG. 1 and is carried on supports 22. A bronze disc 24 and a rubber disc 25 serve to seal the inner area 23 of the housing 11. These sealing measures or similar measures suffice for cases where only slight pressure occurs during operation of the agitator mill in the grinding vessel 3 and in the inner area 23 of the housing 11.

Figure 2:
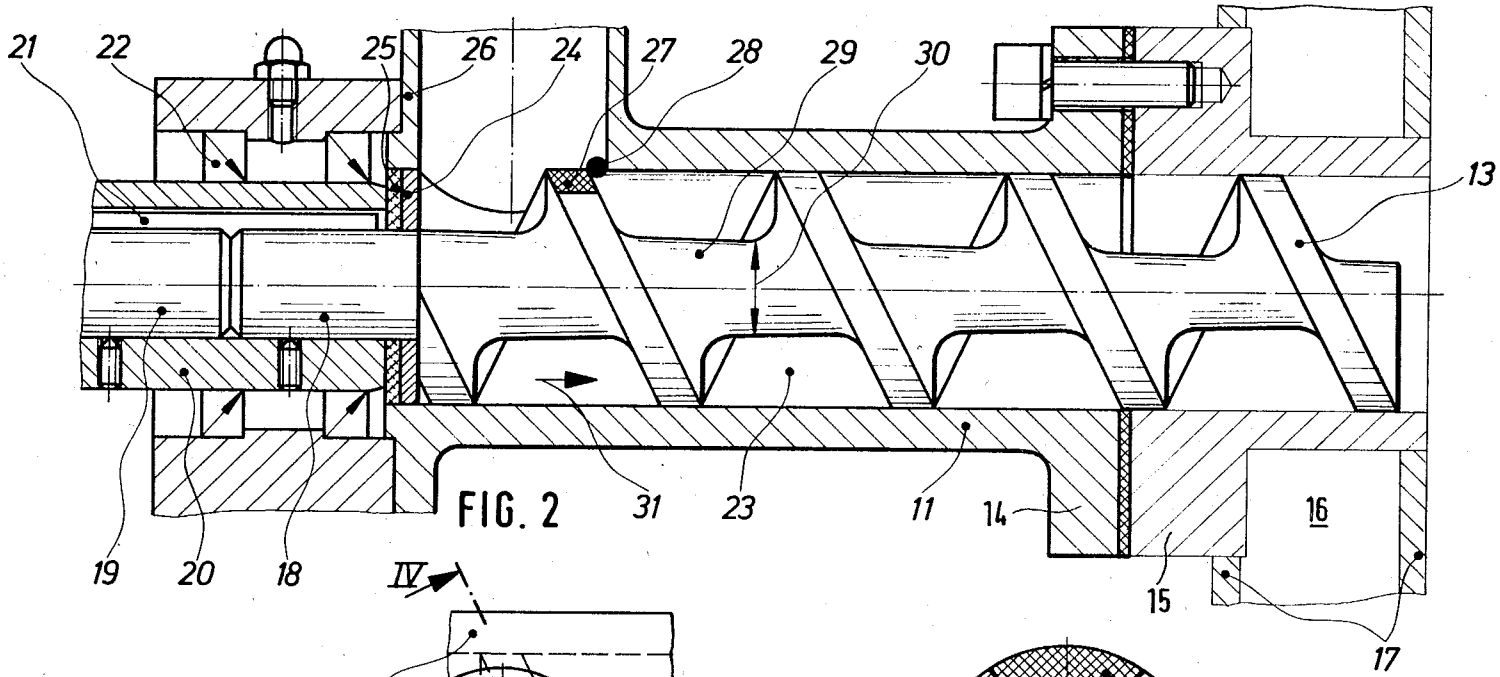
FIG. 2 is a vertical longitudinal section of said device on larger scale
Figure 3:
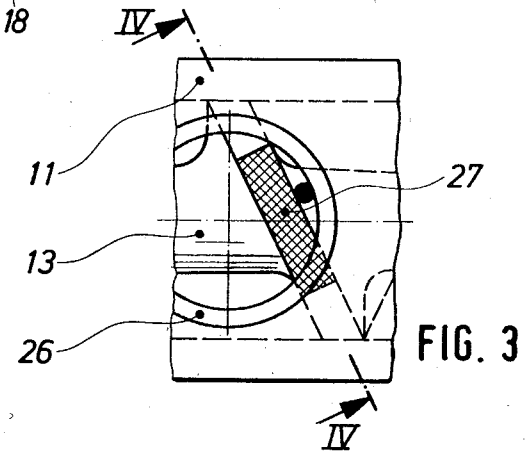
FIG. 3 is a plan view of a part of FIG. 2.
Figure 4:
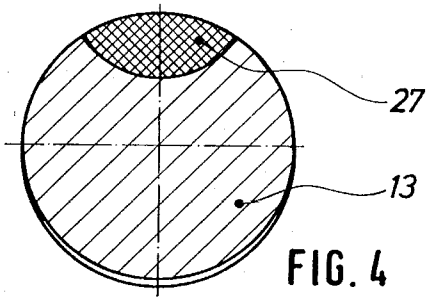
FIG. 4 is a section along the line IV—IV in FIG. 3.

The housing 11 has on its upper side an inlet-pipe connection 26, above which a storage vessel for grinding bodies is disposed, for example, the hopper 12 depicted in FIG. 1 which is open at the top. Underneath the inlet-pipe connection 26, a radially outer spiral portion 27 of the worm 13 is formed of resilient material. For this, a part of a spiral, for example according to FIG. 4, is milled out in curved form and lined with the resilient spiral portion 27, which can, for example, be glued in. Grinding bodies 28 cannot then become jammed at a critical point on the lower edge of the inlet-pipe connection 26, as illustrated in FIG. 2, but are temporarily picked up by the resilient spiral portion 27 and then released as soon as the worm 13 has turned on.

The inner area 23 of the housing 11 can expand conically in the direction of the grinding vessel 3. In all embodiments illustrated, however, the housing 11 is inwardly cylindrical; the worm 13 is consequently outwardly cylindrical but has a core 29 which is formed conically such that its diameter 30 decreases in conveying direction 31. Thus, the free conveying cross section in the inner area 23 of the housing 11 increases in conveying direction 31, thereby preventing blockage with grinding bodies.

Figure 5:
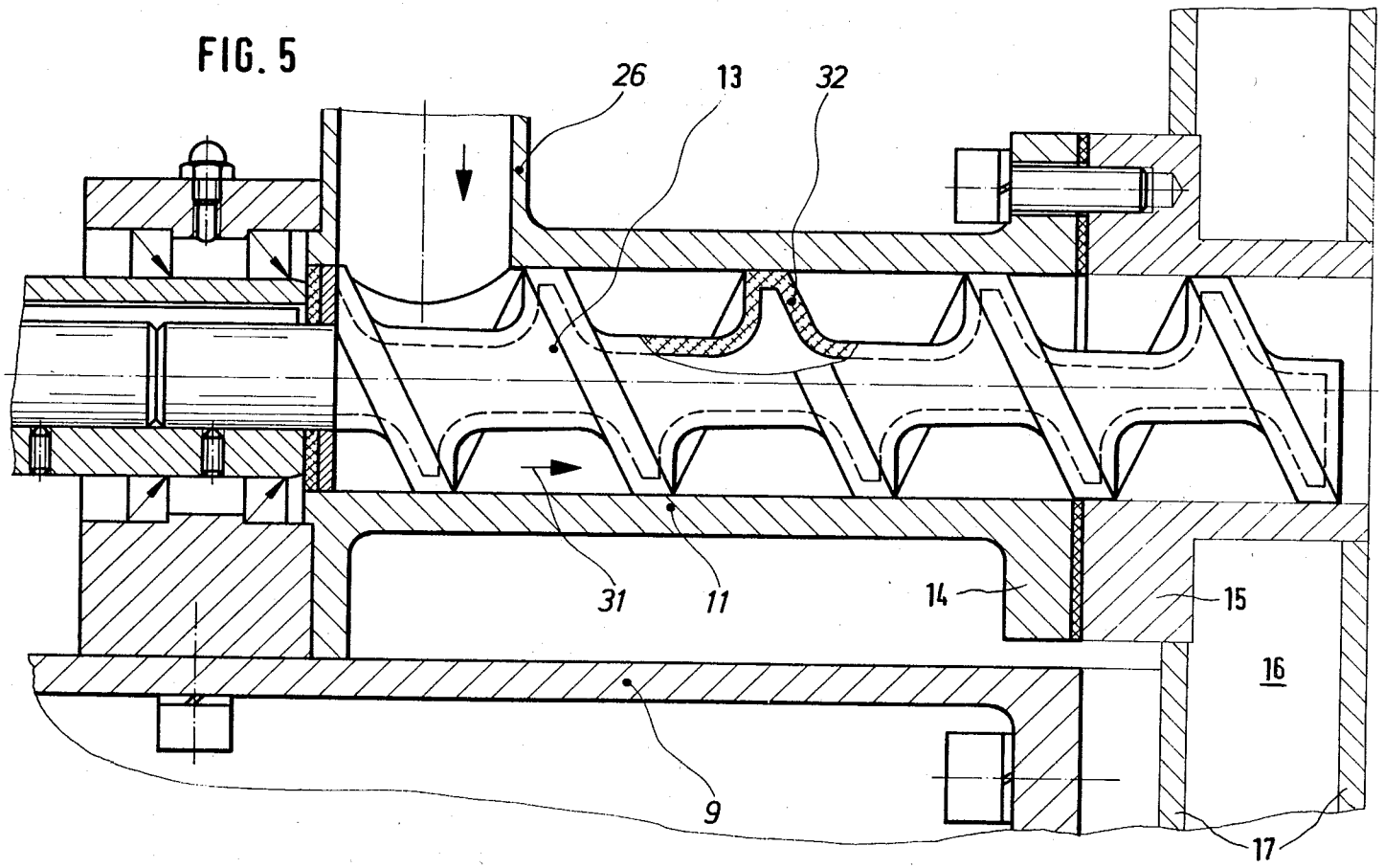
FIG. 5 is a longitudinal section, corresponding to that in FIG. 2, of a second embodiment.
Figure 6:
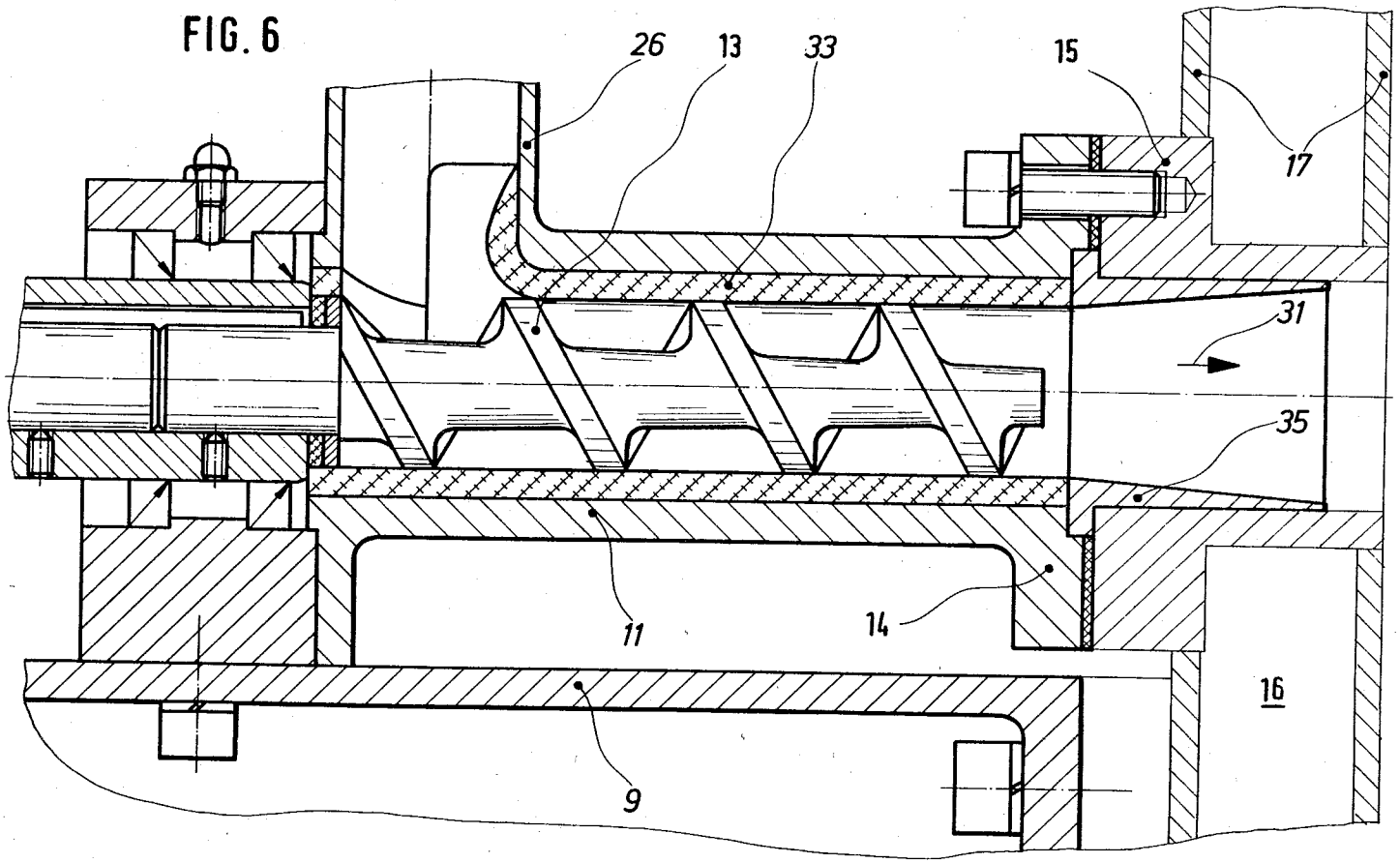
FIG. 6 is a longitudinal section of a third embodiment

According to FIG. 5, not only a limited, radially outer part of the worm 13 is formed of resilient material, but the entire worm 13 is coated with a layer 32 of resilient material, in particular plastic material. In FIG. 6 instead of this, the housing 11 is lined with a layer 33 of resilient material, in particular plastic material. Each of the layers 32 and 33 meets the object of temporarily picking up jamming grinding bodies 28 and reducing wear on grinding bodies 28, housing 11 and worm 13.

In the embodiment illustrated in FIG. 6, the worm 13 is not led through the wall 17 of the grinding vessel 3 but already ends before the insert 15 which in this case contains a bush 35. The inside of the bush 35 is formed conically such that it steadily expands, beginning with the same cross section as the housing 11, in the direction of the grinding vessel 3, i.e., in conveying direction 31. The entire cross section of the bush 35 is freely available to the grinding bodies 28 fed through the worm 13; this is the reason why, in this case also, a congestion of grinding bodies is with certainty avoided.

Figure 7:
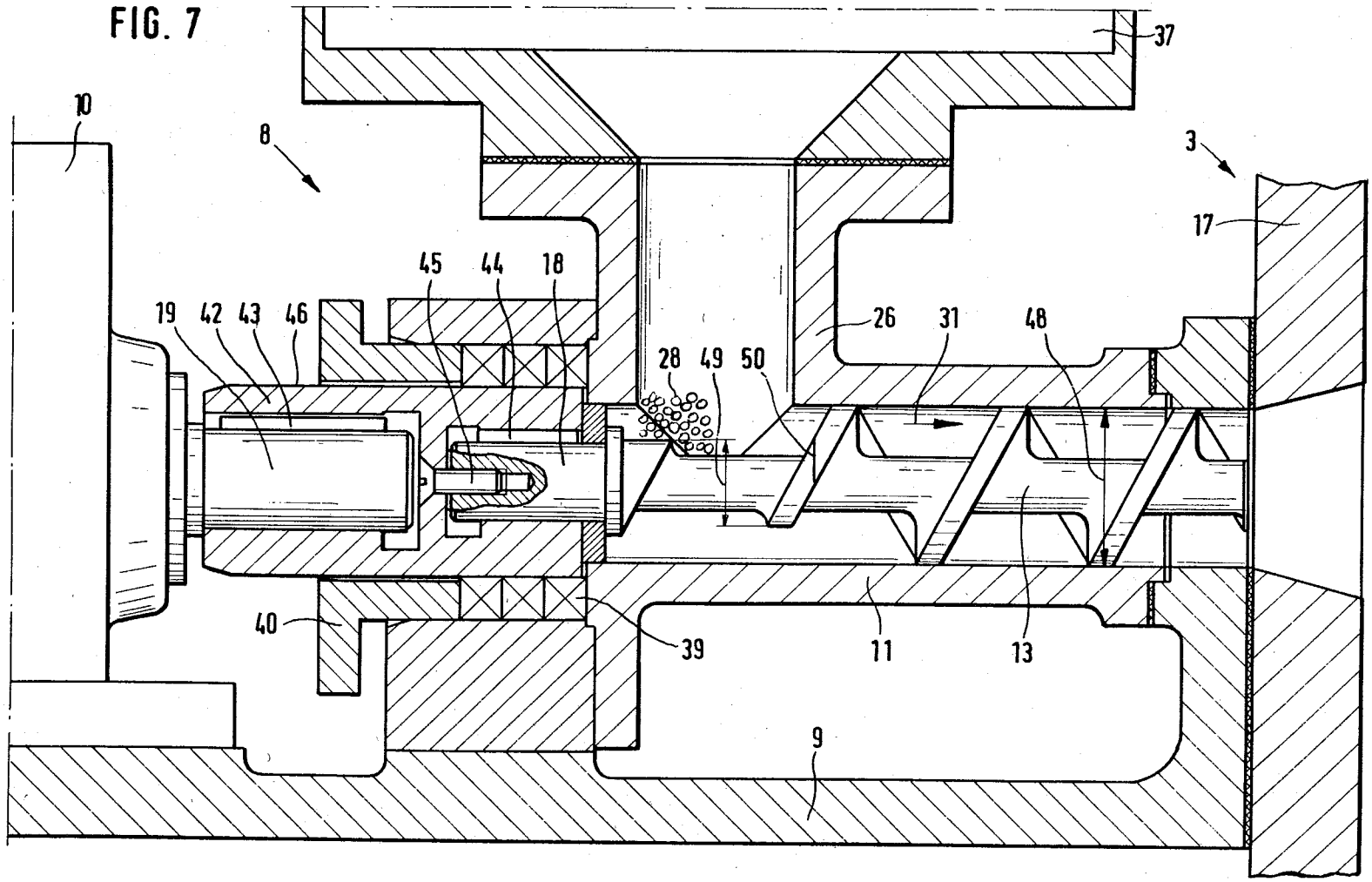
FIG. 7 is a longitudinal section of a fourth embodiment, of the device for feeding in grinding bodies.

FIG. 7 shows an embodiment destined for operation with rather higher pressure in the grinding vessel 3. A higher pressure occurs, for example, when a highly viscous mass is treated in the grinding vessel 3 and is then pumped through a relatively narrow crack or other device for separating material to be ground and grinding bodies. In such cases, the pressure in the worm housing can reach, for example, 2 bar. Instead of the open hopper 12, shown in FIG. 1, a closed, pressure resistant storage vessel 37 is then used for the grinding bodies, this being partially illustrated in FIG. 7 over the inlet-pipe connection 26. The storage vessel 37 can for instance have a volume 30 times as great as that of the housing 11 and be provided with a refill opening for grinding bodies which can be tightly sealed.

According to FIG. 7, a stuffing box with a plurality of rings 39 is disposed at the driving side end of the worm 13 and these rings are compressed by a stuffing box gland 40. The drive pin 18 of the worm 13 and the output pin 19 of the geared motor 10 are inserted in a coupling sleeve 42 and are each connected with this for common rotation by a key 43 and 44 respectively. The coupling sleeve 42 is secured axially by a countersunk screw 45 to the drive pin 18 and has a cylindrical envelope surface 46 as sliding surface for the rings 39 of the stuffing box.

In the embodiment illustrated in FIG. 7, the worm 13 has in its main part an outer diameter 48 which corresponds to the inner diameter of the tubular, cylindrical housing 11. At the start area of the worm 13 on the other hand, under the inlet-pipe connection 26, the worm 13 has only lower spirals with an outer diameter 49. A line 50 indicates the boundary between lower spirals with diameter 49 in the start area and normal spirals with diameter 48 in the main part of the worm 13. This development of the worm 13 likewise contributes to the grinding bodies reaching the housing 11 from the inlet 26 and continuing in conveying direction 31 to the grinding vessel 3 without disturbance.

What is claimed is:

1. An agitator mill comprising a grinding vessel (3) which encloses a grinding area, said grinding vessel being sealed against the outer environment, a storage vessel (37) which contains grinding bodies (28), and a device (8) for feeding said grinding bodies (28) from said storage vessel (37) into said grinding area, said device including a housing (11) and a rotatable worm (13) disposed therein, said storage vessel along with said grinding vessel being also tightly sealed against the outer environment.

2. An agitator mill as claimed in claim 1, in which the worm (13) has a drive pin (18) which is connected via a coupling sleeve (42) with an output pin (19) of a motor (10), said coupling sleeve (42) having an outer envelope surface (46) which is sealed against the housing (11) by a stuffing box (39,40).

3. An agitator mill as claimed in claim 1, in which the housing (11) has a cylindrical inner wall, and in which the worm (13) has a conical core (29) with a diameter (30) decreasing in conveying direction.

4. An agitator mill as claimed in claim 1, in which the storage vessel (37) is connected with an inlet-pipe connection (26) of the housing (11), and in which a spiral portion (27) of the worm (13) arranged in the area of the inlet-pipe connection (26) is formed of resilient material.

5. An agitator mill as claimed in claim 1, in which the storage vessel (37) is connected with an inlet-pipe connection (26) of the housing (11), and in which the worm (13) in the area of the inlet (26) has a smaller outer diameter (49) than inside a main portion of the housing (11) which joins up with the inlet (26).

6. An agitator mill as claimed in claim 1, in which the worm (13) is coated with a layer (32) of a resilient material.

7. An agitator mill as claimed in claim 1, in which the housing (11) is lined with a layer (33) of a resilient material.

8. An agitator mill as claimed in claim 1, comprising a vertical grinding vessel (3), in which the worm (13) is disposed in an at least approximately horizontal position in an upper portion of the grinding vessel (3).

* * * * *